US006772738B2

(12) United States Patent
Rembold et al.

(10) Patent No.: US 6,772,738 B2
(45) Date of Patent: Aug. 10, 2004

(54) INJECTION SYSTEM FOR INTERNAL COMBUSTION ENGINES WITH IMPROVED STARTING PROPERTIES

(75) Inventors: Helmut Rembold, Stuttgart (DE); Klaus Joos, Walheim (DE); Jens Wolber, Gerlingen (DE); Thomas Frenz, Noerdlingen (DE); Markus Amler, Leonbert-Gebersheim (DE); Hansjoerg Bochum, Novi, MI (US); Hans-Peter Harnisch, Cadolzburg (DE); Peter Ropertz, Oberriexingen (DE); Klaus Lang, Stuttgart (DE); Wolfgang Saatmann, Bangalore (IN)

(73) Assignee: Robert Bosch GmbH, Stuttgart (DE)

( * ) Notice: Subject to any disclaimer, the term of this patent is extended or adjusted under 35 U.S.C. 154(b) by 6 days.

(21) Appl. No.: 10/238,521

(22) Filed: Sep. 9, 2002

(65) Prior Publication Data

US 2003/0098016 A1 May 29, 2003

(30) Foreign Application Priority Data

Sep. 8, 2001 (DE) ..... 101 44 125
Jan. 31, 2002 (DE) ..... 102 03 704

(51) Int. Cl.[7] ..... F02M 41/00

(52) U.S. Cl. ..... 123/514; 123/456

(58) Field of Search ..... 123/506, 516, 123/456, 447, 514, 179.17, 461, 198 D, 198 DB

(56) References Cited

U.S. PATENT DOCUMENTS 5,558,068 A * 9/1996 Kunishima et al. ..... 123/516
5,598,817 A * 2/1997 Igarashi et al. ..... 123/179.17
RE36,119 E * 3/1999 Kunishima et al. ..... 123/516
5,992,373 A * 11/1999 Hosoya et al. ..... 123/305
6,021,763 A * 2/2000 Yoshihara et al. ..... 123/516
6,058,912 A * 5/2000 Rembold et al. ..... 123/516
6,176,225 B1 * 1/2001 Sams et al. ..... 123/549
6,615,807 B2 * 9/2003 Rembold et al. ..... 123/516

* cited by examiner

*Primary Examiner*—Mahmoud Gimie
(74) *Attorney, Agent, or Firm*—Ronald E. Greigg

(57) ABSTRACT

An injection system for internal combustion engines is proposed, in which once the engine has been turned off, a pressure equalization is established between the intake side and the pressure side of the high-pressure fuel pump. This prevents uncombusted fuel from reaching the combustion chambers of the engine. The pressure prevailing on the pressure side and the intake side when the engine is off furthermore assures that vapor bubbles cannot form, and this makes starting the engine easier.

21 Claims, 5 Drawing Sheets

INJECTION SYSTEM FOR INTERNAL COMBUSTION ENGINES WITH IMPROVED STARTING PROPERTIES

BACKGROUND OF THE INVENTION

1. Field of the Invention

The invention relates to an injection system for an internal combustion engine, including a high-pressure fuel pump, a low-pressure pump for pumping fuel from a fuel tank to an intake side of the high-pressure fuel pump, and a relief device for lowering the pressure on a pressure side of the high-pressure fuel pump when the engine is switched off, or during the overrun fuel cutoff.

2. Description of the Prior Art

An injection system of the above type is known from German Patent Disclosure DE 195 39 883 A1. In this injection system, after the engine is turned off, a pressure equalization is established between the pressure side of the high-pressure fuel pump and the fuel tank, or the ambient pressure. This provision effectively prevents fuel from reaching the combustion chambers through the injection valves after the engine has been shut off. Because of this uncombusted fuel, there are increased emissions of uncombusted hydrocarbon compounds the next time the engine is started. Because of the incomplete pressure reduction from the pressure side of the high-pressure fuel pump and the tank to the ambient pressure, the pressure buildup adversely affects the starting performance of the engine.

OBJECT AND SUMMARY OF THE INVENTION

The primary object of the invention is to improve the starting performance of this fuel injection system. According to the invention, in an injection system for an internal combustion engine having a high-pressure fuel pump, a low-pressure pump for pumping fuel from a fuel tank to an intake side of the high-pressure fuel pump, and a relief device for lowering the pressure on a pressure side of the high-pressure fuel pump when the engine is switched off, this object is attained in that the pressure on the intake side of the high-pressure fuel pump when the engine is off is greater than or equal to the delivery head of the low-pressure pump, and that the relief device, when the engine is switched off, establishes a pressure equalization between the pressure side and the intake side of the high-pressure fuel pump.

In the injection system of the invention, a partial pressure relief takes place on the compression side of the high-pressure fuel pump after the engine is shut off. However, the pressure is not reduced down to ambient pressure but instead, at most, to a pressure corresponding to the delivery head of the low-pressure pump. The delivery head of a low-pressure pump is typically between 3 and 6 bar, while on the pressure side of the high-pressure fuel pump, pressures of approximately 100 bar prevail during engine operation. Thus all the seals and sealing seats on the pressure side of the high-pressure fuel pump are relieved to such an extent by the partial relief of the invention that it is certain that no fuel can reach the combustion chamber through the injectors or injection valves. As a consequence, in an engine equipped with the injection system of the invention, there are also no emissions of uncombusted hydrocarbon compounds that would originate in fuel that reached the combustion chamber while the engine was off.

Since the pressure prevailing on the pressure side and the intake side of the high-pressure fuel pump is still high enough, while the engine is off, to reliably prevent the creation of vapor bubbles, when the engine is started the pressure required for injection on the pressure side of the high-pressure fuel pump is reached more quickly, and thus a faster start of the engine is made possible. Because of the faster start of the engine, overall emissions from the engine are further improved, and the electrical system is relieved as well. Furthermore, the relief device of the invention is simple in construction and does not require triggering by an electronic control unit of the injection system.

In variants of the invention, it is provided that the relief device includes a bypass line, connecting the intake side and pressure side of the high-pressure fuel pump, and/or a throttle, so that in a simple way, the advantages of the injection system of the invention can be achieved.

In further features of the invention, the throttle can be embodied as a notch in a valve member or in a valve seat of a check valve of the high-pressure fuel pump, or as a perforated baffle. The perforated baffle can be integrated for instance with a common rail of the injection system, or with a check valve on the pressure side of the high-pressure fuel pump.

In an especially advantageous feature of the invention, the check valve is embodied as a flat seat valve, with a counterpart plate that has a valve seat and with a valve plate that cooperates with the valve seat, so that upon closure of the seat valve, a pinch flow is created, which makes for constant cleaning of the notch acting as a throttle. This assures that for the entire service life of the injection system, the notch will not become plugged up and thus will remain functional. Moreover, this embodiment can be produced with high dimensional accuracy, and the cross section of the throttle is virtually constant over the entire service life. It has proved advantageous if the notch has a rectangular, oval or half-round cross section, which is produced especially by electrochemical machining or by a reshaping operation, such as stamping. By these means, high dimensional accuracy is achieved at low production cost.

Alternatively, the throttle can be integrated into a pressure regulating valve of the high-pressure fuel system. This is especially advantageous whenever the relief device of the invention is to be integrated into the injection system with only the slightest possible changes.

In a variant of the invention, it is provided that a pressure-holding device, which in particular can be embodied as a pressure regulating valve or as a check valve, is provided on a pressure side of the low-pressure pump. Using this pressure-holding device reliably and at little cost assures that even with the engine off, a pressure on the intake side and pressure side of the high-pressure fuel pump still remains that is greater than or equal to the delivery head of the low-pressure pump. The development of vapor bubbles can thus be reliably prevented even when the engine is off.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
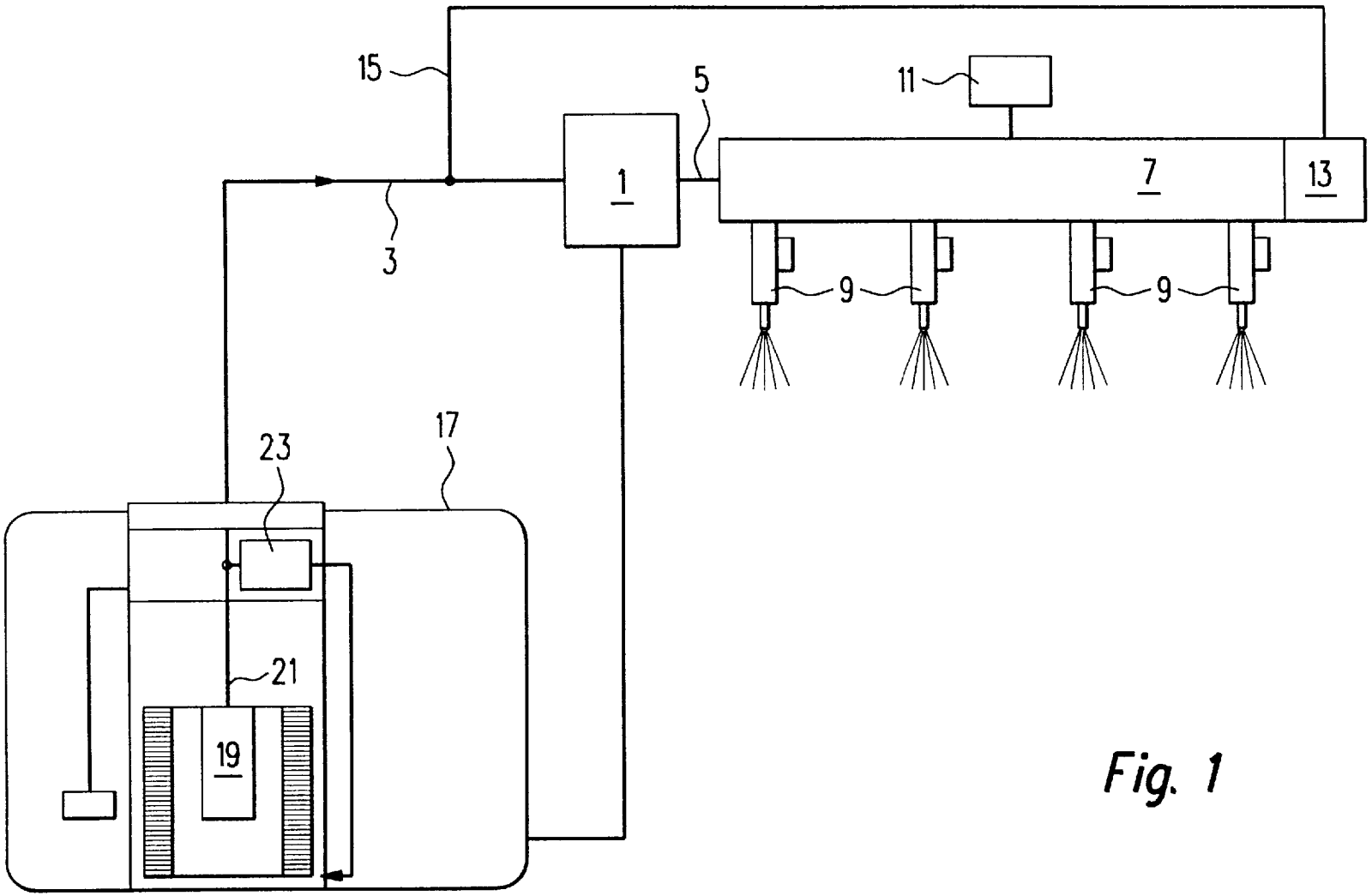
FIG. 1 is a block circuit diagram of a first exemplary embodiment of an injection system of the invention.

In FIG. 1, a first exemplary embodiment of an injection system of the invention is shown as a block circuit diagram in which a high-pressure fuel pump 1 is shown to have an intake side 3 and a pressure side 5. On the pressure side, both a common rail 7 and a plurality of injectors 9 are connected to the high-pressure fuel pump 1. Both a pressure sensor 11 and a first pressure regulating valve or pressure limiting valve 13 are disposed on the common rail 7. From the pressure regulating valve 13, a connecting line 15 leads to the intake side of the high-pressure fuel pump.

The intake side 3 of the high-pressure fuel pump 1 communicates with the discharge side of a low-pressure pump 19 disposed in a tank 17. The low-pressure pump 19 can for instance be an electric fuel pump. In the tank 17, a second pressure regulating valve 23 is disposed between a pressure side 21 of the low-pressure pump 19 and the intake side 3 of the high-pressure fuel pump 1. The second pressure regulating valve 23 assures that the pressure on the intake side 3 of the high-pressure fuel pump 1 is held virtually constant during engine operation. Typically, the pressure on the intake side is between 3 and 6 bar.

When the engine, not shown in FIG. 1, is turned off, the second pressure regulating valve 23 closes and maintains the operating pressure. A throttle, not shown in FIG. 1, in the first pressure regulating valve 13 moreover assures that a pressure equalization takes place between the pressure side 5 and the intake side 3 of the high-pressure fuel pump 1. Thus after the engine is shut off, a pressure prevails both on the intake side 3 and the pressure side 5 that is greater than or equal to the delivery head of the low-pressure pump 19. This effectively prevents the creation of vapor bubbles. Moreover, on the pressure side 5 of the high-pressure fuel pump, such an extensive pressure relief occurs that while the engine is off, no fuel reaches the combustion chambers, not shown, of the engine through the injectors 9.

As a consequence, for the engine equipped with an injection system of the invention, the emissions figures upon starting are quite good, and the engine moreover starts very quickly, which also favorably affects the emissions performance and relieves the electrical system, in particular the starter and the starter battery.

Figure 2:
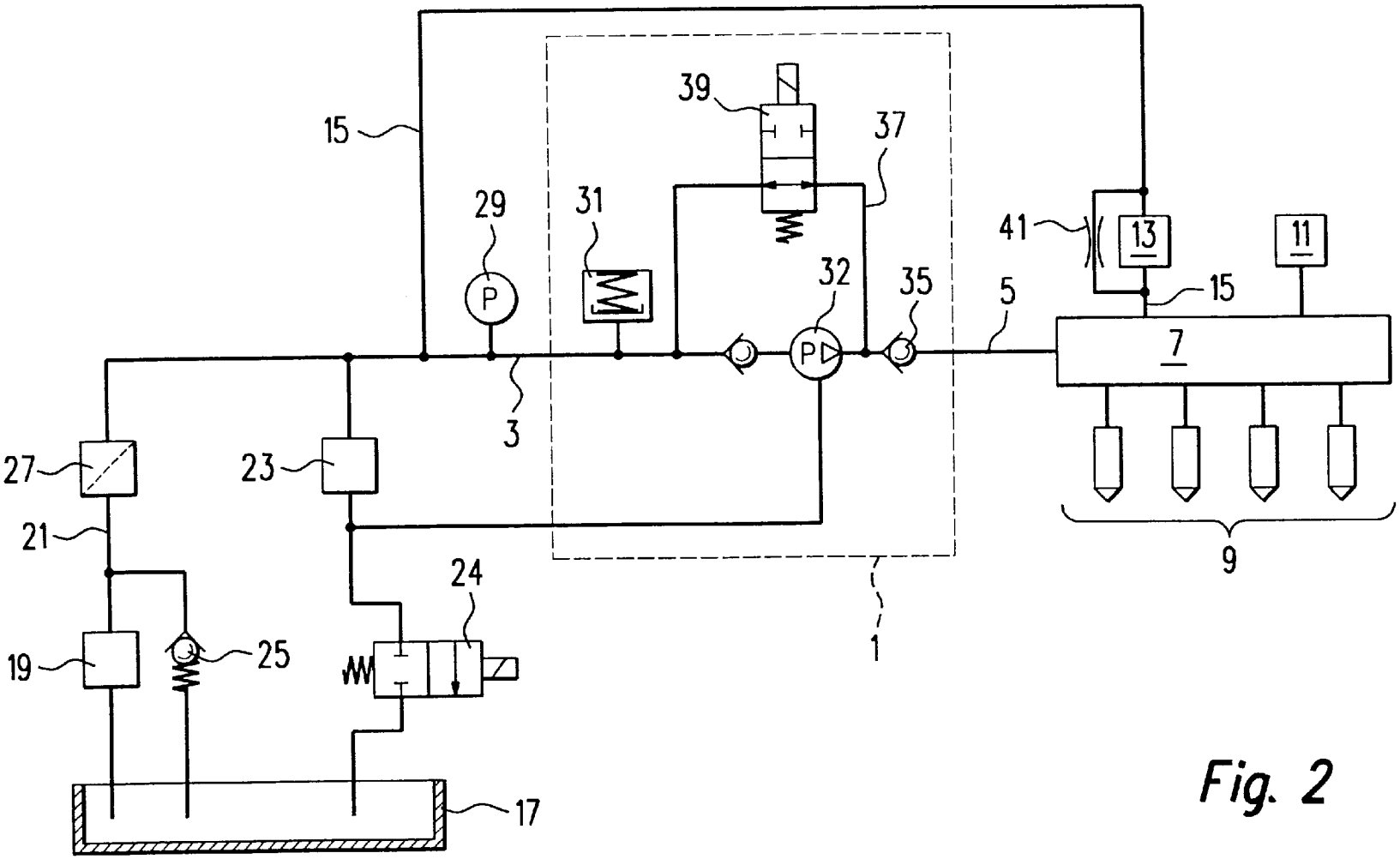
FIG. 2 is a block circuit diagram of a second exemplary embodiment of an injection system of the invention.

In FIG. 2, a second exemplary embodiment of an injection system of the invention is shown as a block circuit diagram. Identical components are provided with the same reference numerals, and their description made in conjunction with FIG. 1 applies accordingly. In this exemplary embodiment, on the pressure side 21 of the low-pressure pump 19, an overpressure relief valve 25 and a fuel filter 27 are also provided. On the intake side 3 of the high-pressure fuel pump 1, there are also a low-pressure sensor 29 and a pressure damper 31. During the operation of the engine, again not shown in FIG. 2, the pressure damper 31 serves to damp pressure surges.

The high-pressure fuel pump 1 has not only a pump element 32 but also a first check valve 35 as well as a bypass 37 with a quantity control valve 39. The quantity control valve serves to regulate the quantity of fuel pumped into the pressure side 5.

A relief device 41 embodied as a throttle is disposed on the first pressure regulating valve 13. The relief device 41 is connected parallel to the first pressure regulating valve 13. This means that both during operation of the engine and while the engine is stopped, a small fuel flow is always carried in the bypass around the first pressure regulating valve 13. During operation, the fuel quantity flowing through the relief device 41 is so slight that it does not significantly affect the operating behavior of the injection system. When the engine is stopped, a pressure equalization between the pressure side 5 and the intake side 3 of the high-pressure fuel pump 1 can be achieved by means of the relief device 41 and the connecting line 15.

A blocking valve 24, which is downstream of the pressure regulating valve 23 and is closed when without current, in this case prevents fuel from taking this route to the tank after the engine is shut off. The pressure in the low-pressure circuit is now established via the overpressure valve 25. Because of the higher opening pressure, a higher pressure is established than via the pressure regulating valve 23, and this further improves the starting performance. It is also advantageous that the leak fuel flow at the pump element, which over a relatively long period leads to a pressure reduction in the low-pressure loop, is blocked via the blocking valve.

Figure 3:
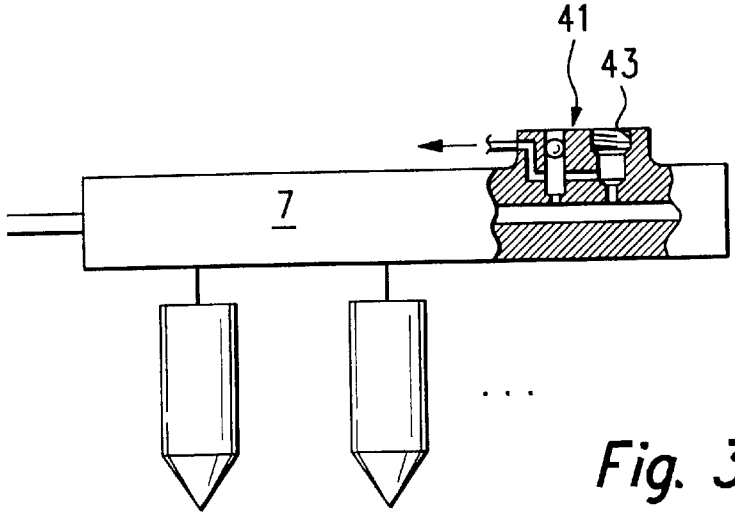
FIG. 3, partly in section, shows a common rail with a relief device.

In FIG. 3, a common rail 7 is shown partly in section. A pressure regulating valve or pressure limiting valve can be screwed into a connection thread 43 of the common rail 7. Parallel to this pressure regulating valve or pressure limiting valve, there is a relief device 41, which will be explained in detail below in conjunction with FIG. 4.

Figure 4:
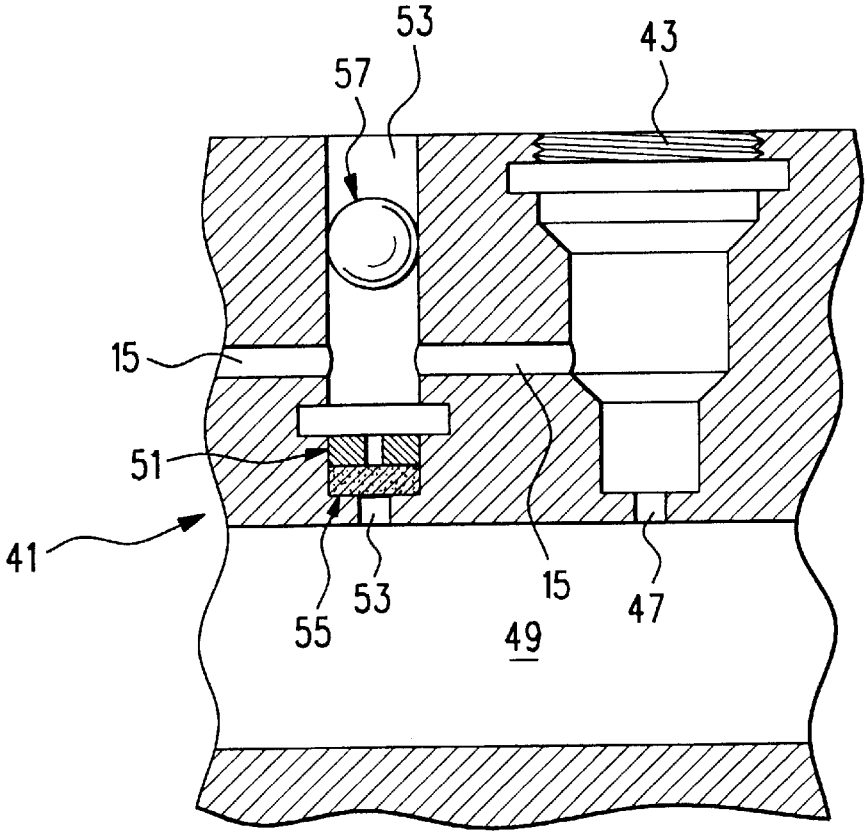
FIG. 4, on a larger scale, shows the part shown in section of the common rail in FIG. 3.

As seen in FIG. 4, the connection thread 43 communicates, via a bore 47, with an inner chamber 49 of the common rail. Parallel to the bore 47, a throttle 51 is disposed in a stepped bore 53. The stepped bore 53 establishes a hydraulic communication between the throttle 51 and the inner chamber 49 of the common rail 7. For protecting the throttle 51, it is preceded by a filter 55. Both the bore 47 and the stepped bore 53 discharge into the connecting line 15. To prevent fuel from emerging into the environment from the stepped bore 53, a ball 57 is press-fitted into the stepped bore 53. It has proved advantageous if the diameter of the throttle 51 is approximately 0.1 mm. However, depending on the engine, the diameter can also deviate in either direction from the diameter mentioned. It is also possible to produce a throttle 51 embodied as a perforated baffle quite economically.

The exemplary embodiment of a common rail 7 shown in FIGS. 3 and 4 is especially well suited for converting an injection system of the prior art into an injection system of the invention. Although the relief device 41 is disposed in the immediate spatial vicinity of the first pressure regulating valve that is to be screwed into the connection thread 43, the components mentioned affect one another only very slightly during engine operation.

Figure 5:
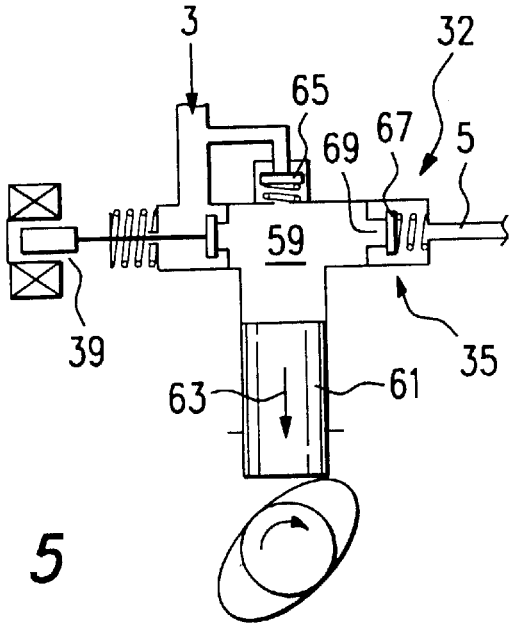
FIG. 5 shows an exemplary embodiment of a relief device integrated with a high-pressure fuel pump.

In FIG. 5, a further exemplary embodiment of a relief device of the invention is shown. In this exemplary embodiment, the relief device is integrated with a pump element 32 of a high-pressure fuel pump 1, which is not shown completely here. The fuel located in a pressure chamber 59 is subjected to pressure by an oscillating pump piston 61. As soon as the pressure in the pressure chamber 59 is greater than the pressure on the pressure side 5 of the high-pressure fuel pump, the first check valve 35 opens, and fuel is pumped out of the pressure chamber 59 to the pressure side 5. When the piston 61 executes a downward motion, represented by an arrow 63 in FIG. 5, the first check valve 35 is closed, and fuel is aspirated via a second check valve 65, disposed on the intake side. The first check valve 35 is embodied as a flat seat valve. A throttle bore 69, shown only in suggested fashion, is present in a valve member 67 of the first check valve 35.

This throttle bore 69, via the quantity control valve 39 that is open when it is without current, assures a pressure equalization between the pressure side 5 and intake side 3 of the high-pressure fuel pump 1 while the engine is stopped.

Figure 6:
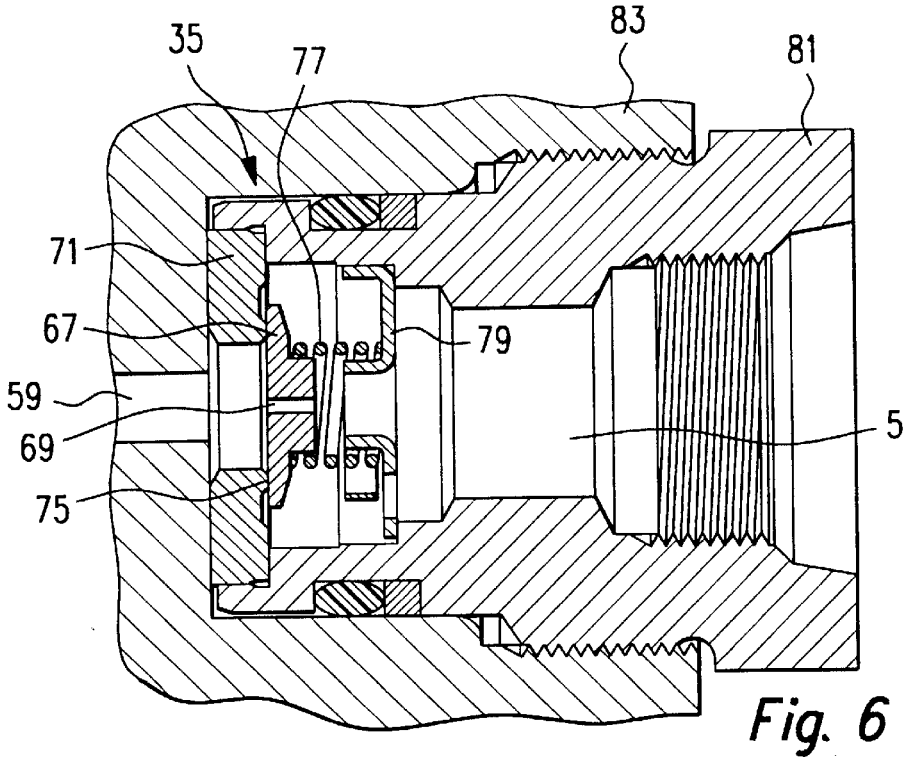
FIG. 6 shows the exemplary embodiment of FIG. 5 on a larger scale.

In FIG. 6, an enlarged view of the first check valve 35 is shown in somewhat more detail. It can be seen from this that the first check valve 35 comprises a counterpart plate 71 and a valve member 67. A valve seat 75, embodied as a flat seat, is machined into the counterpart plate 71. A throttle 69, which connects the pressure chamber 59 with the pressure side 5, is machined into the valve member 67. The valve member 67 is pressed onto the counterpart plate 71 by a compression spring 77. The compression spring 77 is braced on one end on the valve member 67 and on the other on a retaining baffle 79. The retaining baffle 79 is in turn received in a connection neck 81, which is screwed into a housing 83 of the high-pressure fuel pump.

Figure 8:
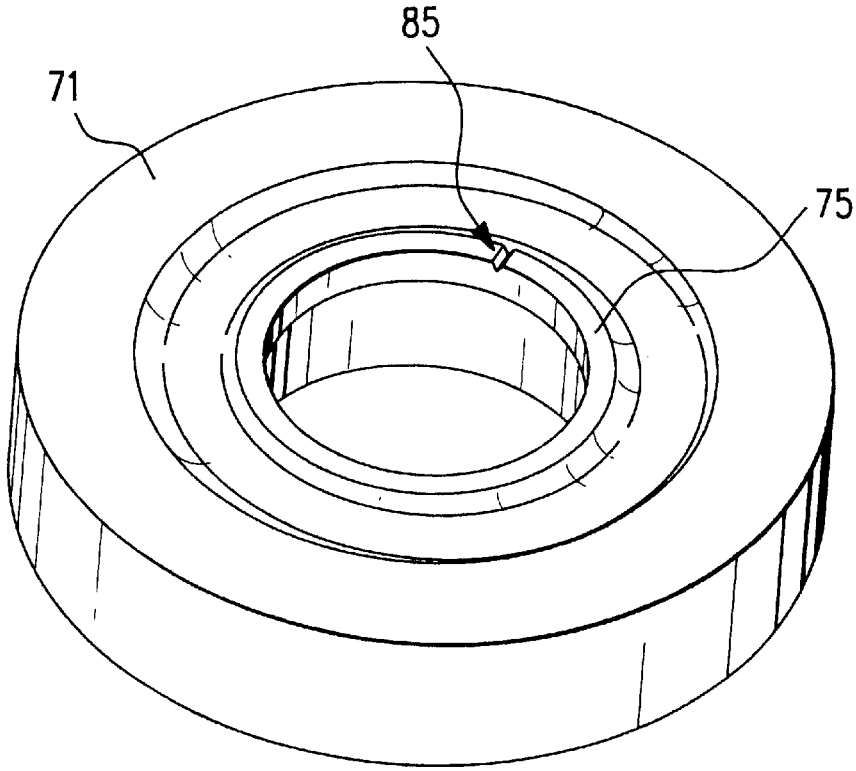
FIG. 8 is a view in perspective of a counterpart plate in the exemplary embodiment of FIG. 7.
Figure 7:
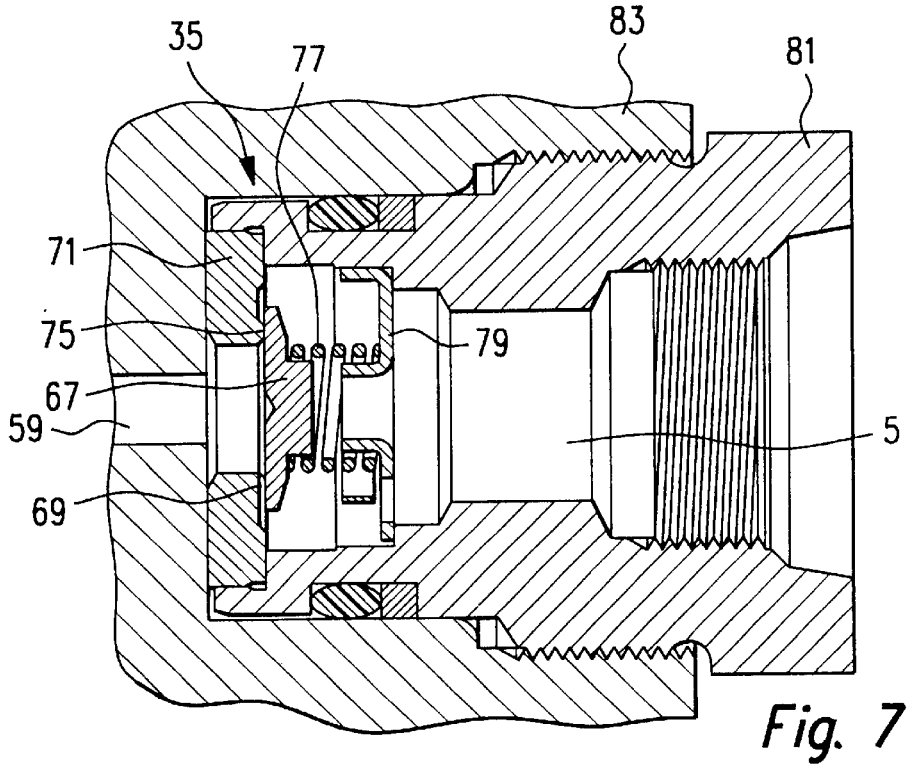
FIG. 7 shows an exemplary embodiment with a check valve, embodied as a flat seat valve.

In FIG. 7, a further exemplary embodiment is shown, with a first check valve 35 embodied as a flat seat valve. A throttle 69 is embodied as a notch in the valve seat 75. In FIG. 8, a perspective view of a counterpart plate 71, which has a valve seat 75 and a notch 85 that acts as a throttle, is shown. Taking FIGS. 7 and 8 together, it is quite clear that when the first check valve 35 is closed and the valve member 67 rests on the valve seat 75 of the counterpart plate 71, a hydraulic communication exists through the notch 85 between the pressure chamber 59 and the pressure side 5. The notch 85 thus has the function of a throttle. Depending on how large the cross section of the notch 85 is, the throttling action of the notch 85 can be adjusted. In this embodiment, it is especially advantageous that the cross section of the notch 85 changes hardly at all over the service life of the first check valve 85, since the bearing face of the valve member 67 on the valve seat 75 is relatively large. Because pinch flows necessarily occur each time the first check valve 35 closes, it is moreover assured that even after many years of operation, no contaminants that can reduce the cross section of the notch 85 or even close the notch 85 completely will be deposited in the notch 85. This assures that the pressure equalization function of the notch 85 is virtually constant over the entire service life of the injection system of the invention. A filter or other kinds of expensive protection devices for the notch 85, devices that are vulnerable to malfunction, are unnecessary.

The foregoing relates to preferred exemplary embodiments of the invention, it being understood that other variants and embodiments thereof are possible within the spirit and scope of the invention, the latter being defined by the appended claims.

We claim:

1. An injection system for an internal combustion engine, the system comprising, a high-pressure fuel pump (1) having an intake side (3) and a pressure side (5), a low-pressure pump (19) for pumping fuel from a fuel tank (17) to the intake side (3) of the high-pressure fuel pump (1), a relief device (41) for lowering the pressure on the pressure side (5) of the high-pressure fuel pump (1) when the engine is switched off, the pressure on the intake side (3) of the high-pressure fuel pump (1) when the engine is off being greater than or equal to the delivery head of the low-pressure pump (19), and the relief device (41), when the engine is off, being operable to establish a pressure equalization between the pressure side (5) and the intake side (3) of the high-pressure fuel pump (1).

2. The injection system of claim 1 wherein the relief device (41) further comprises a connecting line (15) connecting the intake side (3) and the pressure side (5) of the high-pressure fuel pump (1).

3. The injection system of claim 1 wherein the relief device (41) includes a throttle (51).

4. The injection system of claim 2 wherein the relief device (41) includes a throttle (51).

5. The injection system of claim 3 wherein the throttle (51) is embodied as a notch (85) in a seat valve (35).

6. The injection system of claim 4 wherein the throttle (51) is embodied as a notch (85) in a seat valve (35).

7. The injection system of claim 5 wherein the seat valve (35) is embodied as a flat seat valve, with a counterpart plate (71) that has a valve seat (75), and with a valve member (67) cooperating with the valve seat (75).

8. The injection system of claim 7 wherein the notch (85) has a rectangular, half-round or oval cross section.

9. The injection system of claim 8 wherein the notch (85) is produced by electrochemical machining (ECM) or by reshaping, in particular by stamping.

10. The injection system of claim 3 wherein the throttle (51) is embodied as a perforated baffle.

11. The injection system of claim 3 wherein the throttle (51) is integrated with a common rail of the injection system.

12. The injection system of claim 3 wherein the throttle (51, 69, 85) is integrated with a check valve (35) on the pressure side of the high-pressure fuel pump (1).

13. The injection system of claim 7 wherein the throttle (51, 69, 85) is integrated with a check valve (35) on the pressure side of the high-pressure fuel pump (1).

14. The injection system of claim 10 wherein the throttle (51, 69, 85) is integrated with a check valve (35) on the pressure side of the high-pressure fuel pump (1).

15. The injection system of claim 11 wherein the throttle (51, 69, 85) is integrated with a check valve (35) on the pressure side of the high-pressure fuel pump (1).

16. The injection system of claim 12 wherein the check valve (35) is embodied as a flat seat valve.

17. The injection system of claim 1 wherein the delivery head of the low-pressure pump (19) amounts to from 3 bar to 6 bar.

18. The injection system of claim 1 further comprising a pressure-holding device on a pressure side (21) of the low-pressure pump (19).

19. The injection system of claim 18 wherein the pressure-holding device is embodied as a pressure regulating valve (23).

20. The injection system of claim 18 wherein the pressure-holding device is embodied as a check valve.

21. An injection system for an internal combustion engine, the system comprising, a high-pressure fuel pump (1) having an intake side (3) and a pressure side (5), a low-pressure pump (19) for pumping fuel from a fuel tank (17) to the intake side (3) of the high-pressure fuel pump (1) at a delivery head, a relief device (41) for lowering the pressure on the pressure side (5) of the high-pressure fuel pump (1) when the engine is switched off, and means for maintaining the pressure on the intake side (3) of the high-pressure fuel pump (1) greater than or equal to the delivery head of the low-pressure pump (19) when the engine is off, wherein, when the engine is off, the relief device (41) is operable to establish a pressure equalization between the pressure side (5) and the intake side (3) of the high-pressure fuel pump (1), so that when the engine is off, the pressure at the pressure side and the intake side of the high-pressure pump is greater than or equal to the delivery head of the low-pressure pump (19).

* * * * *